United States Patent [19]

Hulings et al.

[11] Patent Number: 4,631,945

[45] Date of Patent: Dec. 30, 1986

[54] BILLET LUBRICATION APPARATUS

[75] Inventors: James E. Hulings, Zelienople; Robert P. Randall, Pittsburgh; Robert H. Maynard, Mars; James Weiss, Wexford, all of Pa.

[73] Assignee: TRACO, Pittsburgh, Pa.

[21] Appl. No.: 800,952

[22] Filed: Nov. 22, 1985

[51] Int. Cl.[4] ..... B21C 23/32

[52] U.S. Cl. ..... 72/43

[58] Field of Search ..... 72/41, 43, 44, 45, 253.1, 72/263, 270, 273.5; 82/53.1

[56] References Cited

U.S. PATENT DOCUMENTS

| | | | |
|---|---|---|---|
| 2,168,203 | 8/1939 | Green | 82/53.1 |
| 3,015,387 | 1/1962 | Evans | 72/41 |
| 3,362,205 | 1/1968 | Edgecombe | 72/44 X |
| 3,478,561 | 11/1969 | Samuel | 72/270 |
| 4,056,964 | 11/1977 | Shibasaki et al. | 72/263 X |
| 4,426,865 | 1/1984 | Steinmetz et al. | 72/44 |
| 4,557,131 | 12/1985 | Wagner et al. | 72/273.5 X |

*Primary Examiner*—E. Michael Combs

*Attorney, Agent, or Firm*—Carothers & Carothers

[57] ABSTRACT

A billet lubrication apparatus which lubricates an end of a metal billet prior to insertion of the billet into an extrusion press by providing for timed, relative rotary coaxial contact between the billet and a solid lubrication medium during transfer of the billet into the extrusion press.

10 Claims, 5 Drawing Figures

BILLET LUBRICATION APPARATUS

BACKGROUND OF THE INVENTION

In the art of metal extrusion, especially aluminum extrusion, it is well known that the billet to be extruded is heated to an elevated temperature, in the range of 800° F. for example. Although preheating of the billet is considered highly desirable or even necessary for extrusion operations, it also is known to introduce certain problems due primarily due to the sticky or tacky nature of the heated billet. For example, one common problem has been the tendency of a billet butt to cling to the shear blade after it has been sheared from the extrusion die face after extrusion of the billet. This has resulted in the need for butt knockoff bars and other similar expedients to insure that the billet butt does not remain hung up on the shear blade.

Another problem resulting in large part from the tacky property of a heated billet is that the closing plate which closes the rear end of the extrusion container in indirect extrusion tends to adhere to the rear end of the billet. In the case of direct extrusion, the same problem appears in the interface between the rear end of the billet and the dummy block which resides between the billet and the extrusion stem.

As a solution to this problem, it is known to lubricate the interface between the billet and the dummy block or closing plate by applying lubricant to the billet. Typically, and especially for fixed dummy arrangements, only one of a given number of billets in a sequence of billets needs to be lubricated as the lubricant from a billet will transfer to the dummy block and will be effective for lubrication of a number of subsequent billets. The prior practice of billet end lubrication has included, for example, manual lubrication by the press operator during an interruption in the transfer cycle which transfers the billet from the billet shear into the extrusion press. This approach has been viewed as inefficient and therefore undesirable.

Another prior means of billet end lubrication has been the use of a gas burner which burns acetylene gas to produce carbon for deposit on the billet end by projecting the acetylene flame at the billet end. This approach also is inefficient and is undesirable due to the open flame of the burner. In addition, as with the above mentioned manual lubrication approach, interruption of the billet transfer cycle is undesirable. Furthermore, the acetylene flame produces much unnecessary airborne particulte contamination.

Still another problem of prior billet lubrication schemes has been the common use of hydraulic fluid drive for the billet transfer mechanism. Due to the large magnitude of hydraulic pressure forces utilized (e.g. 3600 psi) hydraulic fluid power is not preferred as a careless worker could sustain injury in working around the large, hydraulically driven transfer components. Nevertheless, in another sense hydraulic power is preferred to provide a uniform, repeatable mid-cycle stopping point for the billet transfer mechanism to accommodate the desired billet lubrication. This is especially true if billet lubrication is performed by a device located at a predetermined position with respect to the transfer cycle.

By contrast, air power cannot provide the desired repeatability due to the compressability of the air and the massive loads the air is moving. When attempting to stop the billet transfer cycle in midstroke under air power, the transfer carriage will tend to drift from the desired position and thus will not remain in alignment with a relatively stationary lubrication apparatus.

BRIEF SUMMARY OF THE INVENTION

The above and other shortcomings of the prior art are alleviated by the present invention, according to which there is provided a novel lubrication apparatus which carries a solid lubricant for rotation on an axis that is coaxial with the axis of a billet at a predetermined midstroke position in the billet transfer cycle between the extrusion press and a preceding billet processing station such as a furnace or shear. The apparatus of this invention also is operable to move the solid lubricant axially into and out of engagement with the billet end in coordination with the timed axial rotation thereof to permit a sufficient coating of lubricant to be deposited on the billet end. A 70% coverage of lubricant on the billet end is generally considered to be sufficient.

Further aspects of the invention include an air over oil billet transfer mechanism fluid power system which provides the combined benefits of both air and hydraulic fluid power while avoiding the shortcomings of each in positioning the billet precisely at the lubrication position; that is, in axial alignment with the lubrication apparatus axis of rotation. Also provided by the invention is a cooperating mechanical latch which is operative to physically stop the billet transfer carriage at the predetermined lubrication position thus augmenting the consistent repeatability of the hydraulic fluid power drive and thereby assuring the desired precise midstroke positioning of the billet transfer carriage for lubrication of the billet end.

Accordingly, it is one general object of the invention to provide a novel and improved billet end lubrication apparatus for use in conjunction with an extrusion press.

A more specific object of the invention is to provide an apparatus for lubrication of a billet end in conjunction with transfer of the billet from a preceding operation into an extrusion press.

Another specific object of the invention is to provide an apparatus for coordinated relative motion of a billet and a billet lubricating medium, including relative transverse, axial, and rotary motion with respect to the axial extent of the billet to lubricate the billet end. These and other objects and further advantages of the invention will be more readily apparent upon consideration of the following detailed description and the accompanying drawings, in which.

Figure 1:
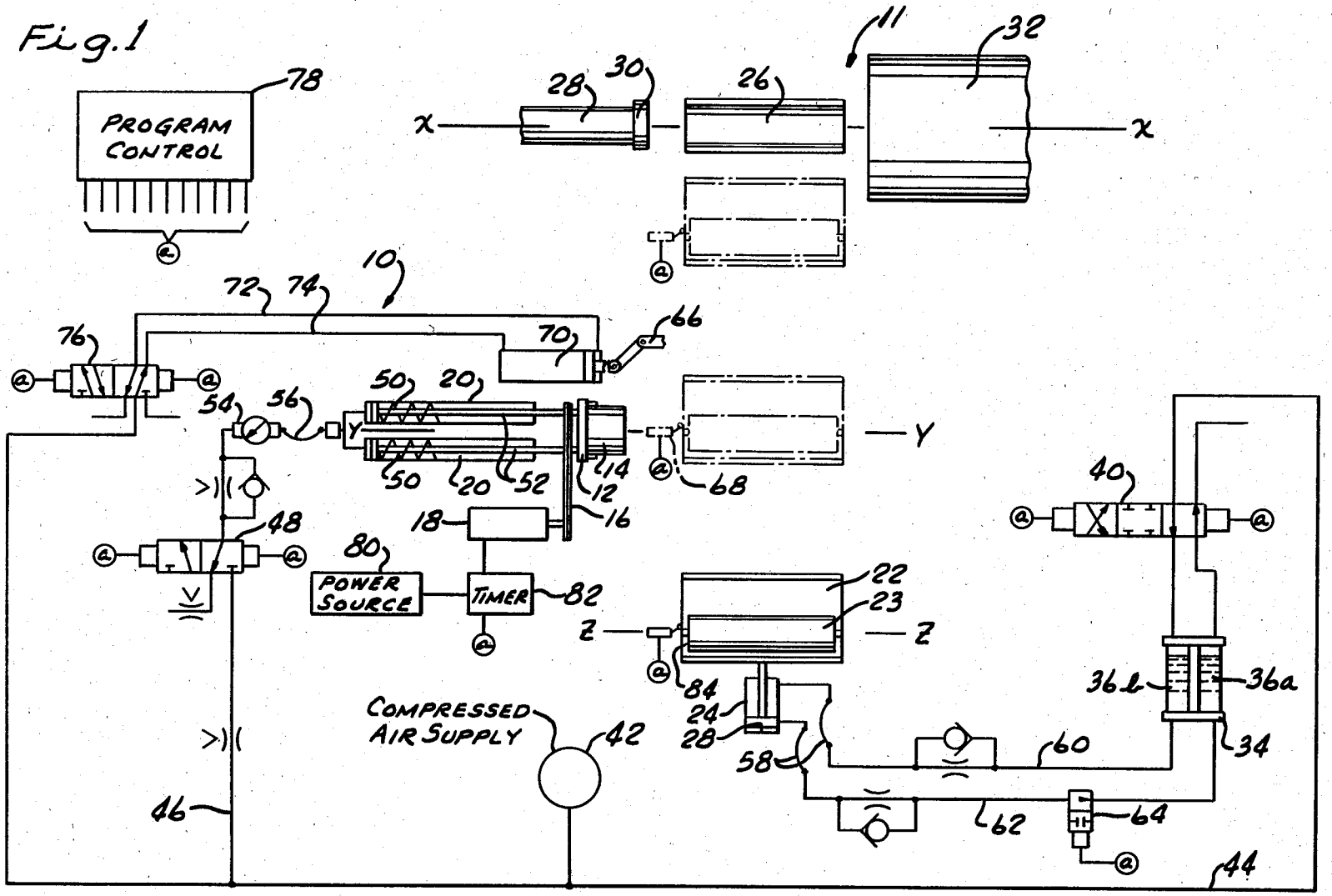
FIG. 1 is a simplified schematic diagram of a billet end lubrication apparatus of the present invention.

There is generally indicated at 10 in FIG. 1 a billet lubrication apparatus constructed according to one presently preferred embodiment of the instant invention for use in conjunction with a conventional extrusion press 11. Apparatus 10, shown in FIG. 1 in simplified schematic form for purposes of descriptive clarity, comprises an electrically powered rotary chuck 12 which carries a solid lubricant 14 and is selectively rotatable through a chain and sprocket drive 16 by a motor 18, preferably a D.C. motor. Chuck 12 may also be selectively moved to and fro along its axis of rotation Y—Y by spring return pneumatic cylinder assemblies 20.

A conventional billet transfer carriage 22 is powered by a double acting hydraulic cylinder assembly 24 to transfer a metal billet 23 from an axis Z—Z where it has been previously deposited from a prior operation such as preheating and/or shearing, transversely to a position in alignment with axis Y—Y for lubrication of the billet end, and thence to a position in alignment with press axis X—X where the billet is deposited in a receiving trough or carrier 26. As is well known, subsequent to the transfer operation, the press stem 28 is moved axially along axis X—X to bring fixed dummy 30 into endwise engagement with billet 23 to push the billet axially from carrier 26 into an extrusion container 32 preparatory to extrusion of the billet 23 through a suitable die (not shown).

Although cylinder 24 is fluid powered, the fluid pressure impetus is achieved through application of air pressure to a hydraulic fluid surface in a fluid reservoir 34 that is comprised of a pair of fluid chambers **36*a*, 36*b*. Chambers 36*a* and 36*b* alternately function as part of the fluid supply and return lines, respectively, depending upon whether the piston 38 of cylinder 24 is being extended or retracted. This is known as an air over oil fluid pressure system. In the system, a solenoid operated control valve 40 receives pressurized air from a suitable source 42 via a conduit 44 and delivers the air to one of chambers 36*a*, 36*b* while venting the other of the chambers 36*a*, 36*b*. The air pressure differential acting within chambers 36*a*, and 36*b* on the respective fluid surfaces provides hydraulic fluid impetus to cylinder 24 to drive carrier 22 as above described. Air source 42 also provides pressurized air via a conduit 46 to a solenoid operated valve 48 to operate cylinders 20 by providing sufficient pressure to overcome the return impetus of return springs 50 in cylinders 20 and thereby extend the piston rods 52**.

Such conventional air pressure system components as a pressure regulator 54 and a moisture trap 56 may also be included in the air pressure supply line to cylidners 20 as shown. Similar conventional components may be provided as needed in fluid lines 60 and 62 which deliver pressurized hydraulic fluid from chambers **36*b*, 36*a*, respectively, to cylinder 24. In particular, an auxiliary solenoid operated cut-off valve 64 is provided in the cylinder advance fluid line 62 to lock up the hydraulic system and prevent drift of carrier 22 from the lubrication system axis Y—Y, even if main solenoid valve 40** experiences leakage when in the center or cut-off position.

To augment the precise stopping of carrier 22 at the lubrication position, a mechanical air powered latch 66 is closed to project into the path of travel of carrier 22. As carrier 22 moves from axis Z—Z to axis Y—Y, it engages latch 66 simultaneously with engagement of a limit switch 68 that operates valves 40 and/or 64 to stop carrier 22 precisely at the lubrication position in axial alignment with axis Y—Y. Latch 66 is powered by an air cylinder 70 which receives actuating air via conduit 72, 74 from a solenoid operated control valve 76.

All of the control valves, limit switches and other control components described above and hereinabelow are controlled by actuating signals generated in suitable program control circuitry, preferably integrated in the program control circuitry 78 of press 11.

From the above, operation of the invention will be readily appreciated. With suitable and appropriate program controls, the press 11 is programmed to automatically process a continuous sequence of billets 23. Accordingly, transfer carrier 22 is correspondingly programmed to deliver a sequence of such billets at predetermined times in the press cycle laterally from axis Z—Z to press axis X—X. As carrier 22 thus approaches intermediate axis Y—Y during a billet delivery cycle, it simultaneously engages limit switch 68 and latch 66. Limit switch 68 causes actuation of solenoid valves 40 and 64 to close the valves thus locking up the hydraulic fluid in conduit 62 and the air pressure on the fluid surfaces in chambers **36*a*, 36*b*. This positions carrier 22 with the billet 23 thereon precisely on axis Y—Y and in contact with latch 66. The latch assures that the momentum of the carrier 22 does not carry it beyond a position of alignment with axis Y—Y after actuation of valves 40 and 64**.

Next in the sequence of operation, D.C. motor 18 is energized from a suitable power source 80 and a timer 82 to impart axial rotation to chuck 12 for a predetermined time period. Simultaneously, valve 48 is actuated to supply pressurized air for extending the rods 52 of cylinders 20, which rods 52 carry chuck 12 adjacent their forwardmost ends. The pressure regulator 54 keeps the actuating air pressure to cylinders 20 low enough to provide firm but not overly forceful engagement of the outer exposed face of the lubricant 14 with billet 23 as the piston rods 52 are advanced. When lubricant 14 engages the confronting end 84 of billet 23, it is rotating with respect thereto and thus deposits a uniform film of the lubricant on the end surface 84.

At the end of the timed lubrication operation, which lasts for approximately 4 seconds for example, the motor 18 and the cylinders 20 are deenergized, thus discontinuing the powered rotation of chuck 12 and permitting piston rods 52 to retract under the impetus of springs 50 thereby axially separating lubricant 14 from billet end 84. The advance rate of cylinder rods 52 is sufficient that the major part of the lubrication cycle is spent with the lubricant in rotary contact with the billet end 84; however, the proportion of the timed lubrication cycle spent in actual lubricating contact is variable according to permissible variation in the axial location of the billet end 84. An alternative mode of lubrication cycle control would include substitution of a billet end position sensing instrument for a fixed time to start lubrication stick rotation. With this approach, the lubrication stick would rotate only when in contact with the billet end rather than throughout a longer cycle period.

Simultaneously with termination of billet end lubrication, valve 76 is actuated by program control 78 to supply air to cylinder 70 for opening latch 66, and valves 64 and 40 are returned to the appropriate fluid supply positions to continue transfer of the billet 23 to press 11. The lubricated end 84 will thus be engaged by fixed dummy block 30, or other end fixtures such as a closing plate or a free dummy block (not shown) without adhering thereto.

The operating sequence of the apparatus described, and the control elements by which operation is carried out, may of course be varied according to the dictates of a wide range of mechanical and/or operational parameters of the particular press 11. Most notably, the apparatus of this invention may be utilized in conjunction with any of a variety of direct or indirect extrusion presses, and for lubricating either or both ends of a billet. Lubrication of the forward end of the billet is desirable to improve the ease with which the billet butt may be sheared from the die face after the extrusion operation, for example.

Figures 2, 3, 4, 5:
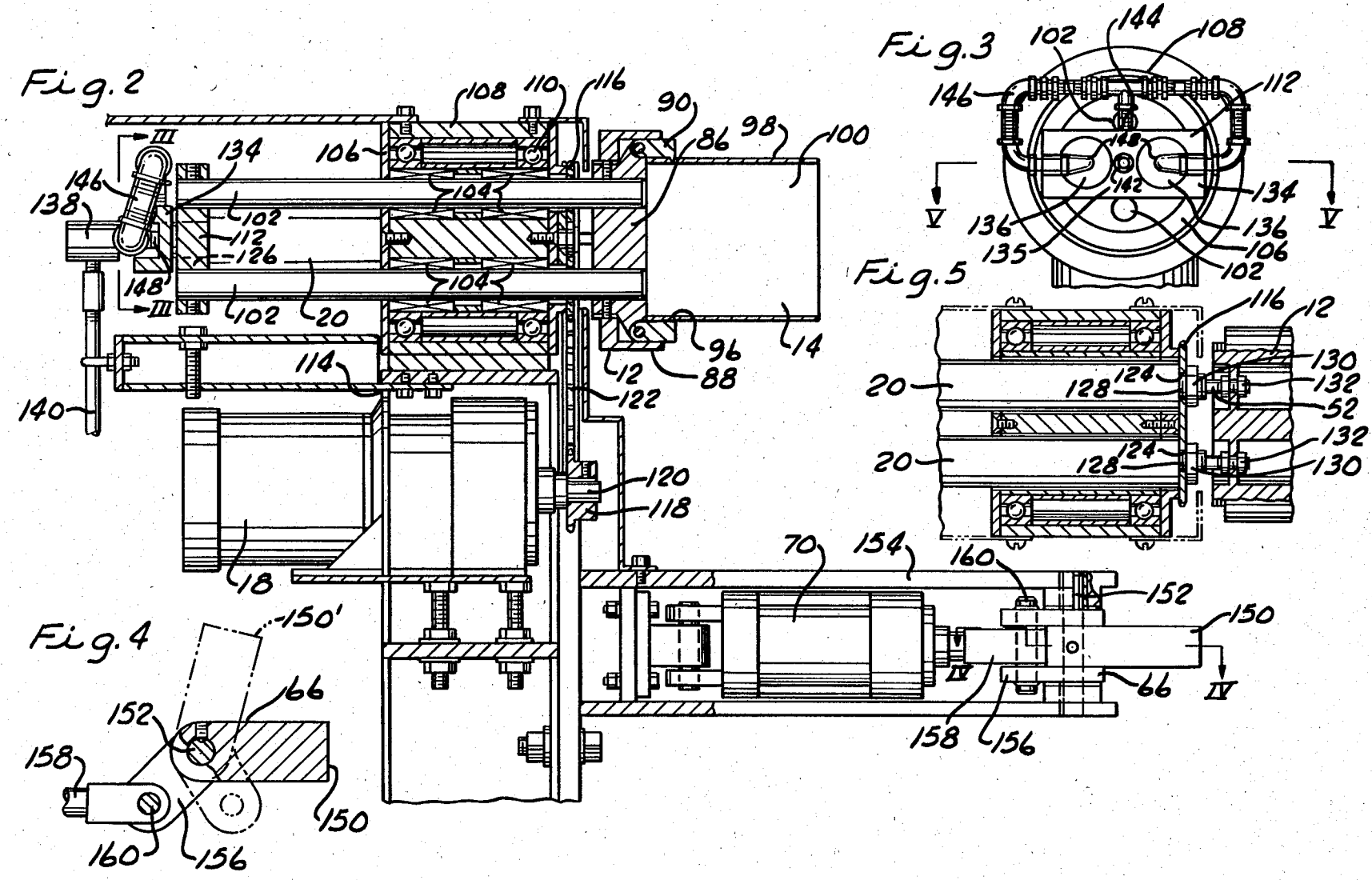
FIG. 2 is a detailed transverse section of the lubrication medium carrier and drive of the invention.
FIG. 3 is a fragmentary, partially sectioned end elevation taken on lines III—III of FIG. 2.
FIG. 4 is a fragmentary, partially sectioned top plan view taken on line IV—IV of FIG. 2.
FIG. 5 is a fragmentary transverse section taken on line V—V of FIG. 3.

FIGS. 2–5 illustrate structural details of the invention. In FIG. 2, chuck 12 comprises an end plate 86 having an adjustable collet ring 88 threaded thereon. A plurality of circumferentially spaced pawls 90 are pivotally affixed to plate 86 and each has an inclined radially outer surface 92 which is engageable by an encompassing annular skirt portion 94 of collet ring 88. As ring 88 is advanced forward by rotation thereof, skirt 94 engages surface 92 causing teeth 96 of the pawls 90 to dig into a cylindrical casing 98 which contains solid lubricant 100 (e.g. a wax stick) to fixedly clamp the lubricant 14 in chuck 12.

To support axial sliding and rotation of chuck 12 with respect to the stationary motor 18, the chuck 12 is mounted on a plurality of slide rods 102 which are guided in bushings 104, and bushings 104 are in turn carried in a rotary cage 106 that is rotatably mounted in a stationary housing 108 by ball bearings 110. The rod 102 and bushings 104 may be any suitable longitudinally sliding support apparatus such as Thompson Ball Bushings of Thompson Industries, Inc. The rods 102 are secured together adjacent their rearward ends by an end plate 112, and the chuck 12 thus is supported for longitudinal sliding and axial rotation with respect to housing 108. Housing 108, in turn, is rigidly mounted with respect to motor 18 as both are carried by a common frame 114.

A driven sprocket 116 is affixed coaxially to the forward end of rotary cage 106 intermediate the cage 106 and chuck 112, and in a common plane with a drive sprocket 118 which is secured to shaft 120 of motor 18. A roller chain 122 engages sprockets 116 and 118 to permit the motor 18 to drive the longitudinally slidable chuck 12 in axial rotation.

Also extending within rotary cage 106 parallel to slide rods 102 is the pair of spring return pneumatic cylinders 20 (FIGS. 2 and 5). The opposite ends of each cylinder 20 are received and secured in a pair of spaced, axially aligned bores 124, 126, formed in sprocket 116 and end plate 112, respectively. A threaded forward collar portion 128 of each cylinder 20 projects through the respective bore 124 and receives a nut 130 to secure the cylinder 20 with respect to sprocket 116. The opposite end of each cylinder 20 is secured within the respective one of bores 126 by any suitable expedient, a set screw for example (not shown). The extensible piston rod 52 of each cylinder 20 is affixed, as by nuts 132 engaging a forward threaded end thereof, with respect to chuck 12.

Accordingly, application of air pressure to cylinders 20 extends rods 52 and thus moves chuck 12 axially with respect to housing 108 as slide rods 102 provides support for the chuck 12 throughout such longitudinal sliding. Since cylinders 20 rotate with rotary cage 106, orbiting the axis of rotation Y—Y of sprocket 116 as do the slide rods 102, the axial sliding motion of chuck 12 may occur simultaneously with axial rotation thereof.

The air connection which supplies pressurized air to cylinders 20 comprises a manifold assembly 134 which receives the outermost ends 136 of cylinders 20 and a rotary union assembly 138 which provides for pressurized air flow from a stationary supply line 140 to the rotatable manifold 134 via rotary union 138. As shown, manifold 134 comprises a block member 135 having an air inlet 142 (FIG. 3) that is coaxial with the axis of rotation of rotary cage 106, and an air outlet 144 that is connected by piping assembly 146 with the respective air connections 148 of cylinders 20.

Also shown in FIGS. 2 and 4 are details of the latch 66 which comprises a pawl 150 that is pivotally secured by a pivot pin 152 intermediate the legs of a bifurcated support bracket 154 for rotation between a closed position as shown in FIG. 4 in solid lines, and an open position shown at 150' in FIG. 4.

An angled, bifurcated yoke portion 156 of pawl 150 receives the forward end of the piston rod 158 of cylinder 70 and is secured thereto by a pivot pin 160 whereby selective extension and retraction of rod 158 by actuation of cylinder 70 causes latch 66 to open and close. Support bracket 154 is preferably, but not necessarily an integral part of the above described support frame 114.

In accordance with the description hereinabove, the present invention provides a novel and improved apparatus for lubrication of a billet end in conjunction with transfer of the billet into an extrusion press of extrusion thereof. Of course, it will be appreciated that the inventors have contemplated various alternative and modified embodiments of the invention. Accordingly, it is intended that the invention be construed broadly and limited only by the scope of the claims appended hereto.

We claim:

1. In a metal extrusion apparatus wherein an extrusion press is utilized to extrude elongated forms from axially elongated metal billets, the combination for lubricating (a longitudinal) an axial end surface of such a billet comprising:

lubricant application means located adjacent such an extrusion press and adapted to carry a solid lubricating medium;

billet transfer means located adjacent such an extrusion press and adapted to transfer such a billet transversely of its own axial extent into such an extrusion press along a predetermined path of travel which includes a lubrication position whereat such billet axial end surface is located in axially aligned confronting relationship with the solid lubricating medium carried by said lubricant application means;

arresting means for arresting travel of said billet transfer means at said lubrication position; and said lubricant application means including selectively operable linear drive means cooperable with said arresting means for advancing such lubricating medium axially into engagement with such an axial end surface of such an arrested billet and selectively operable rotary drive means for axial rotation of such lubricating medium during such axial movement and engagement thereof with such an axial end surface to provide for rotary application of such lubricating medium to such an axial end surface during transfer of such billet to such an extrusion press by said transfer means.

2. The combination as claimed in claim 1 wherein said transfer means includes a fluid powered cylinder assembly for driving said transfer means along said predetermined path of travel and an air over oil power system wherein pressurized air provides motive force to hydraulic fluid for hydraulic operation of said fluid powered assembly.

3. The combination as claimed in claim 2 additionally including control means cooperable with said arresting means, said linear drive means and said rotary drive means for stopping said transfer means with such a billet therein at said lubricating position for a time period of predetermined duration and for operating said linear drive means to axially advance such lubricating medium into engagement with such billet end with timed maintenance of said engagement only during said time period while simultaneously operating said rotary drive means to rotate such lubricating medium for application of lubricant to such billet end surface during said engagement.

4. The combination as claimed in claim 3 wherein said arresting means includes a selectively operable latch means which is engageable with said transfer means and is cooperable with said control means to arrest said transfer means at said lubrication position.

5. The combination as claimed in claim 4 wherein said arresting means additionally includes a limit switch means which is cooperable with said control means and responsive to the position of said transfer means in said predetermined path of travel to stop said transfer means in engagement with said latch means by discontinuing hydraulic fluid flow to said fluid powered cylinder assembly.

6. The combination as claimed in claim 5 wherein said linear drive means is a fluid operable cylinder means.

7. The combination as claimed in claim 6 wherein said rotary drive means includes an electrically powered motor means.

8. An apparatus for applying lubricant to an end surface of an elongated billet prior to placement of the billet in an extrusion press for extrusion thereof, comprising:

a billet transfer means adapted to traverse a predetermined path of travel in transferring a billet to such an extrusion press;

arresting means cooperable with said transfer means to stop said transfer means and thereby arrest the billet at a predetermined position in its path of travel to such extrusion press;

a rigid housing located adjacent said path of travel;

a rotary cage carried by said housing for selective rotation with respect thereto on an axis of rotation which coincides with said predetermined position;

selectively operable extension means carried by said rotary cage for rotation therewith and including extensible means which are selectively axially movable parallel to said axis of rotation upon actuation of said extension means;

a chuck affixed with respect to said extensible means and adapted to carry a solid lubrication medium on said axis of rotation for selective axial movement of said solid lubrication medium along said axis of rotation in conjunction with axial movement of said extensible means;

longitudinally slidable guide means affixed with respect to said chuck and coextending parallel to said extension means; said guide means being slidably supported within said rotary cage and cooperable with said extension means to support and guide said chuck with respect to said rotary cage during such axial rotation and such axial movement thereof to bring such lubricating medium axially into engagement with such an arrested billet; and rotary drive means maintained continuously in driving engagement with said rotary cage for selectively driving said rotary cage in such axial rotation at least during said engagement of such lubricant with such billet.

9. The apparatus as claimed in claim 8 wherein said rotary drive means includes a chain and sprocket drive means having a driven sprocket affixed coaxially with respect to said rotary cage and a roller chain engaging said driven sprocket.

10. The apparatus as claimed in claim 9 wherein said selectively operable extension means includes a plurality of fluid powered cylinder means and said extensible means are piston rod portions of said fluid powered cylinder means.

* * * * *